US005227035A

United States Patent [19]

Briot et al.

[11] Patent Number: 5,227,035

[45] Date of Patent: Jul. 13, 1993

[54] NITROHYDROFLUORIC DEVELOPMENT BATH FOR TITANIUM ALLOY COMPONENTS

[75] Inventors: Francois P. Briot, Sedan; Michel Biencourt, Saint Michel Sur Orge; Claude G. G. Gondel, Beaumont/Oise; Philippe P. E. Riot, Noisiel; Michel M. Ruimi, Paris, all of France

[73] Assignee: Societe Nationale D'Etude et de Construction de Moteurs d'Aviation, Paris, France

[21] Appl. No.: 894,566

[22] Filed: Jun. 5, 1992

[30] Foreign Application Priority Data

Jun. 12, 1991 [FR] France ..... 91 07147

[51] Int. Cl.[5] ..... C25F 3/08

[52] U.S. Cl. ..... 204/129.75

[58] Field of Search ..... 204/129.75

[56] References Cited

U.S. PATENT DOCUMENTS 3,502,552 3/1970 Mizushima et al. ..... 205/322

*Primary Examiner*—T. M. Tufariello

*Attorney, Agent, or Firm*—Oblon, Spivak, McClelland, Maier & Neustadt

[57] ABSTRACT

A nitrohydrofluoric development bath for use in an electro-chemical etching process, known as the "blue etch process", for the non-destructive inspection of titanium or titanium alloy components such as turbomachine blades and discs, the bath comprising, per liter, 320 g of nitric acid, from 13 to 22 g of hydrofluoric acid, from 4 to 7 g of dissolved titanium, and water as the balance.

5 Claims, No Drawings

NITROHYDROFLUORIC DEVELOPMENT BATH FOR TITANIUM ALLOY COMPONENTS

FIELD OF THE INVENTION

The invention relates to the nitrohydrofluoric development bath in an electro-chemical etching process for titanium alloy components comprising, in succession, the steps of degreasing, rinsing, activation by acid etching, rinsing, anodic oxidation in a trisodium phosphate bath, rinsing, and development by etching in a nitrohydrofluoric bath.

BACKGROUND OF THE INVENTION

The operating conditions of turbo-engines, especially aircraft engines, have led to the utilization of numerous titanium or titanium alloy components in such engines. It is important that these components should be subjected to a non-destructive checking capable revealing the various defects from which they may suffer. In particular, they should be examined for possible manufacturing defects such as segregations, inclusions, porosity, etc., transformation defects such as cracks, incrustations, heterogeneity, contaminations, etc., and machining or polishing defects such as work-hardening, local overheating, etc. For this purpose, there is in existence an electro-chemical etching process which is well known in the art as the "blue-etch process".

This electro-chemical etching process consists, generally, in carrying out the following operations on the component to be checked:

1. Conventional degreasing by immersion in an alkaline bath;
2. Rinsing with cold water in a tank of running water, or by sprinkling;
3. Possible removal of a work-hardened layer, about 5 microns, by fluo-nitric etching;
4. Rinsing with cold water in a tank of running water;
5. Chemical activation by immersion in an acid salt bath for etching with a macrographic effect;
6. Rinsing with cold water in a tank of running water;
7. Anodic oxidation in a trisodium phosphate bath, with the component to be checked being in the anode position;
8. Rinsing with cold water in a tank of running water;
9. Development by partial etching in a nitrohydrofluoric bath;
10. Rinsing with cold water as quickly and thoroughly as possible, followed by drying of the component; and
11. Reading the defects revealed, on the basis of shapes and colours (white, blue, grey-blue) which are peculiar to them.

However, this process does have some drawbacks. In particular, the nitrohydrofluoric development bath used in step 9 generally has a composition comprising, per liter, 320 g nitric acid ($HNO_3$), from 13 to 22 g hydrofluoric acid (HF), and water the balance, and this requires the development to be carried out within a period of from 2 to 10 seconds, and the transfer time between the development bath and the rinsing of step 10 to be between 2 and 5 seconds. Exceeding one of these limits brings about complete discoloration of the component, making any detection of defects impossible.

As will be appreciated, it is not a problem to keep within these limits when treating components which are of relatively small size and simple shape, since these can be quickly handled and rinsed. However, this is not the case for relatively large components of complex shape, such as turbo-engine discs for example. It is therefore necessary, for such components, to reduce the activity of the developer bath so that the immersion and transfer times can be increased to be compatible with the process and handling equipment required for the components.

One way of reducing the reaction kinetics of the development bath is to reduce the concentration of the hydrofluoric acid in the bath. Unfortunately this solution results in a bath which becomes exhausted very quickly, and which therefore has a very short life and does not permit reliable results to be obtained.

DESCRIPTION OF THE INVENTION

The invention provides an alternative and more acceptable way of reducing the activity of the development bath, that is to say its reaction kinetics, by including in the bath from 4 to 7 g/l of dissolved titanium.

More precisely, according to the invention there is provided a nitrohydrofluoric development bath for use in an electro chemical etching process for titanium alloy components comprising, in succession, the steps of degreasing, rinsing, activation by acid etching, rinsing, anodic oxidation in a trisodium phosphate bath, rinsing, and development by etching in a nitrohydrofluoric bath, said development bath comprising, per liter, 320 g of nitric acid, from 13 to 22 g of hydrofluoric acid, from 4 to 7 g of dissolved titanium, and water as the balance.

Preferably the development step is carried out with the bath at a temperature between 20° C. and 30° C., and with the duration of immersion between 25 and 50 seconds.

The use of the development bath in accordance with the invention, i.e. with the bath including dissolved titanium in the proportion of from 4 to 7 g/l, has given very satisfactory results, particularly when the bath contains 22 g/l hydrofluoric acid and the $HNO_3$/HF ratio is 14.5. With the bath at a temperature of between 20° C. and 30° C., the invention enables the development step to be operated with an immersion time close to 30 seconds followed by 15 seconds for the transfer to the rinsing bath, which is perfectly compatible with an industrial process, even for large components.

We claim:

1. A nitrohydrofluoric development bath, comprising:

i) nitric acid;
ii) 13–22 g of hydrofluoric acid;
iii) 4–7 g of dissolved titanium; and
iv) water as the balance;

wherein, said nitric acid is present at a molar concentration of about 5.08.

2. A development bath according to claim 1, wherein the hydrofluoric acid concentration is 22 g/l.

3. A nitrohydrofluoric development bath, comprising:

i) 320 g/l of nitric acid;
ii) 13–22 g/l of hydrofluoric acid;
iii) 4–7 g/l of dissolved titanium; and
iv) water.

4. An electro-chemical etching process for titanium alloy components comprising, in succession, the steps of degreasing, rinsing, activating by acid etching, rinsing, anodic oxidation in a trisodium phosphate bath, rinsing, and development by etching in a nitrohydrofluoric bath;

wherein said development step is carried out in a development bath, at a temperature of between 20° and 30° C., which comprises:

i) nitric acid;

ii) 13–22 g of hydrofluoric acid;

iii) 4–7 g of dissolved titanium; and iv) water as the balance;

wherein, said nitric acid is present at a molar concentration of about 5.08.

5. An electro-chemical etching process for titanium alloy components comprising, in succession, the steps of degreasing, rinsing, activating by acid etching, rinsing, anodic oxidation in a trisodium phosphate bath, rinsing, and development by etching in a nitrohydrofluoric bath;

wherein said development step is carried out in a development bath, at a temperature of between 20° and 30° C., which comprises:

i) 320 g/l of nitric acid;

ii) 13–22 g of hydrofluoric acid;

iii) 4–7 g of dissolved titanium; and iv) water.

* * * * *

UNITED STATES PATENT AND TRADEMARK OFFICE

CERTIFICATE OF CORRECTION

PATENT NO. : 5,227,035
DATED : July 13, 1993
INVENTOR(S) : Francois Briot, et. al.

It is certified that error appears in the above-indentified patent and that said Letters Patent is hereby corrected as shown below:

Column 1, line 19, "capable revealing", should read --capable of revealing--.

Signed and Sealed this

Eleventh Day of October, 1994

*Attest:*

*Attesting Officer*

BRUCE LEHMAN

*Commissioner of Patents and Trademarks*